US006412247B1

(12) United States Patent
Menchetti et al.

(10) Patent No.: US 6,412,247 B1
(45) **Date of Patent: *Jul. 2, 2002**

(54) COMPOSITE STRUCTURAL MEMBER AND WALL ASSEMBLY METHOD

(75) Inventors: Robert J. Menchetti, Buffalo; Matthew J. Kessler, Lancaster, both of NY (US)

(73) Assignee: National Gypsum Properties, LLC, Charlotte, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/515,197

(22) Filed: Feb. 29, 2000

Related U.S. Application Data

(63) Continuation of application No. 08/725,238, filed on Oct. 6, 1996, now Pat. No. 6,061,995, which is a continuation-in-part of application No. 08/610,308, filed on Mar. 4, 1996, now abandoned.

(51) Int. Cl.[7] ..... E04C 3/30

(52) U.S. Cl. ..... 52/731.1; 52/730.4; 52/730.5; 52/731.2; 52/731.3; 52/731.5; 52/736.3; 52/794.1; 52/784.12; 52/481.1; 52/784.13; 52/784.15

(58) Field of Search ..... 52/730.4, 730.5, 52/731.2, 731.3, 731.5, 736.3, 794.1, 784.12, 481.1, 784.13, 784.15, 731.1

(56) References Cited

U.S. PATENT DOCUMENTS

| | | | |
|---|---|---|---|
| 694,014 A | 2/1902 | Helbing | |
| 947,514 A | 1/1910 | Stevens | |
| 965,595 A | 7/1910 | Nicholson | |
| 1,285,051 A | 11/1918 | Cramer | |
| 1,475,409 A | 11/1923 | Riddle | |
| 1,559,134 A | 10/1925 | Utzman | |
| 1,564,264 A | 12/1925 | Murray | |
| 1,615,815 A | 1/1927 | Birdsey | |
| 1,794,079 A | 2/1931 | Kellett | |
| 2,062,399 A | 12/1936 | Coddington | |

(List continued on next page.)

FOREIGN PATENT DOCUMENTS

| | | | |
|---|---|---|---|
| CA | 905 700 | 7/1972 | |
| DE | 29 17 551 | 11/1979 | |
| DE | 3114296 A1 | 4/1981 | ..... E04C/3/29 |
| DE | 31 14 296 | 11/1982 | |
| DE | 34 31 667 | 3/1986 | |
| DE | 43 16 931 | 11/1994 | |
| EP | 0327261 A1 * | 8/1989 | ..... 52/794.1 |
| EP | 0 327 261 | 8/1989 | |
| FR | 323100 | 2/1903 | |
| GB | 581754 | 10/1946 | |

(List continued on next page.)

OTHER PUBLICATIONS

Notice of the Reason of Rejection dispatched on Oct. 10, 2000.

International Search Report of International Application No. PCT/US97/14743, International Filing Date Aug. 21, 1997.

*Primary Examiner*—Carl D. Friedman
*Assistant Examiner*—Dennis L. Dorsey
(74) *Attorney, Agent, or Firm*—Howrey, Simon, Arnold & White, LLP

(57) ABSTRACT

This disclosure relates to a composite structural member comprising a body part and multiple rigid strips which are attached to and separated by the body part. The body part is formed by a core having substantially flat parallel sides and opposed edges, and the opposed edges are covered by the rigid strips. As an example, the core is made of gypsum, and the strips are made of sheet metal. The rigid strips enable screw fasteners to be secured to the structural member. The sides of the core are preferably covered by side sheets.

19 Claims, 16 Drawing Sheets

U.S. PATENT DOCUMENTS

| | | | | | |
|---|---|---|---|---|---|
| 2,085,472 | A | | 6/1937 | Roush | |
| 2,092,106 | A | | 9/1937 | Coddington | |
| 2,134,674 | A | | 10/1938 | Sherman et al. | |
| 2,200,159 | A | | 5/1940 | Davis, Jr. | |
| 3,271,919 | A | * | 9/1966 | Olton | 52/794.1 |
| 3,350,257 | A | | 10/1967 | Hourigan et al. | |
| 3,488,904 | A | * | 1/1970 | Schneller et al. | 52/794.1 |
| 3,531,901 | A | | 10/1970 | Will, Jr. et al. | 52/309 |
| 3,535,842 | A | | 10/1970 | Karn | |
| 3,798,867 | A | | 3/1974 | Starling | |
| 3,922,828 | A | | 12/1975 | Patton | |
| 4,001,993 | A | | 1/1977 | Daniels | |
| 4,312,158 | A | | 1/1982 | Teli et al. | |
| 4,466,225 | A | | 8/1984 | Hovind | |
| 4,630,419 | A | | 12/1986 | Pilgrim | |
| 5,148,645 | A | | 9/1992 | Lehnert et al. | |
| 5,222,335 | A | | 6/1993 | Petrecca | |
| 5,440,848 | A | | 8/1995 | Deffet | |
| 6,061,995 | A | * | 5/2000 | Menchetti et al. | 52/794.1 |

FOREIGN PATENT DOCUMENTS

| | | | | | |
|---|---|---|---|---|---|
| GB | 1 052 891 | | | 12/1966 | |
| GB | 1 244 735 | | | 9/1971 | |
| GB | 2025503 | A | * | 1/1980 | 52/794.1 |
| GB | 2 025 503 | | | 1/1980 | |
| GB | 2 027 104 | | | 2/1980 | |
| GB | 2 214 949 | A | | 9/1989 | E04B/1/74 |
| GB | 2 259 723 | | | 3/1993 | |
| GB | 2259723 | A | * | 3/1993 | 52/794.1 |
| JP | 55-141625 | | | 3/1954 | |
| JP | 57-88820 | | | 11/1955 | |
| LU | 58 854 | | | 11/1969 | |
| NL | 681 3361 | | | 4/1969 | |
| NL | 910738 | | | 5/1993 | |
| NL | 9200654 | | | 5/1993 | |
| SE | 210 266 | | | 1/1967 | C04B/39/08 |

* cited by examiner

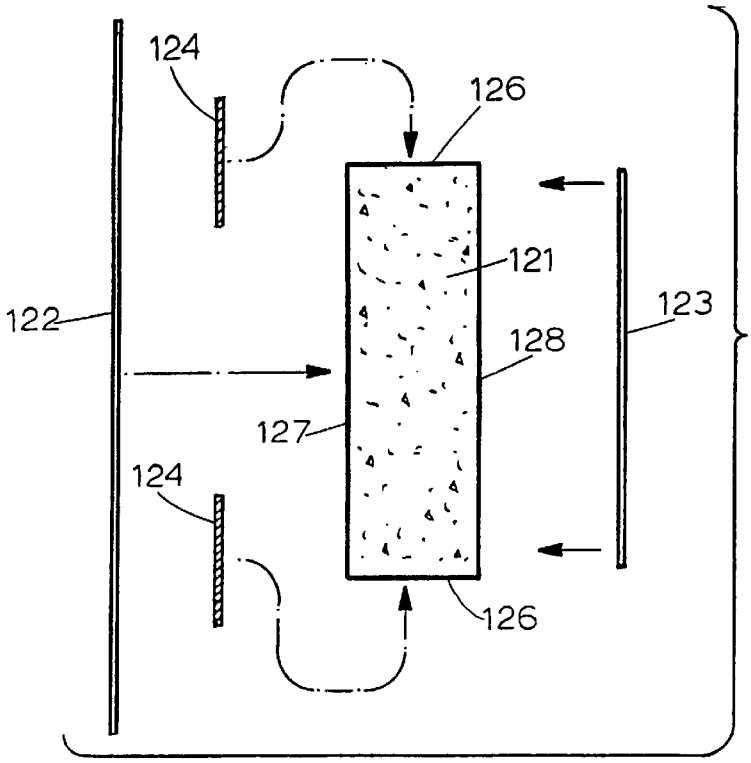
FIG. 17
FIG. 18
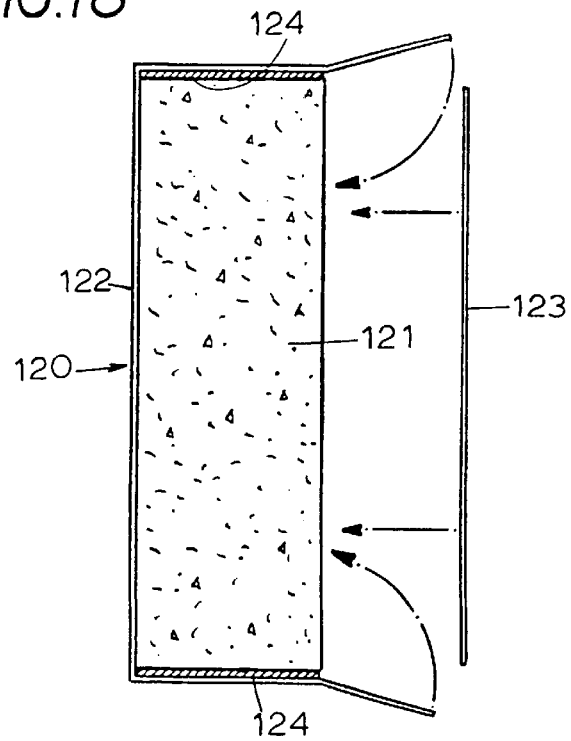
FIG. 19
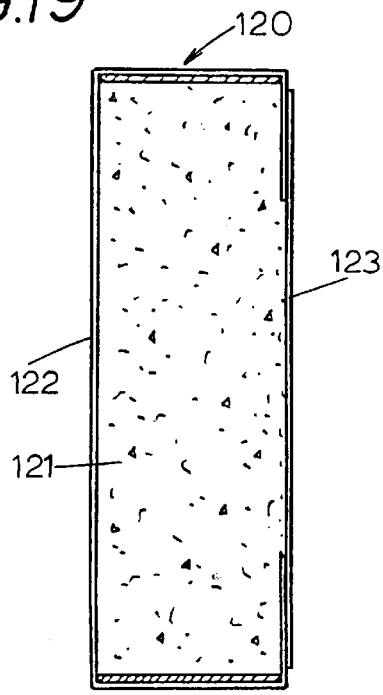

FIG. 23
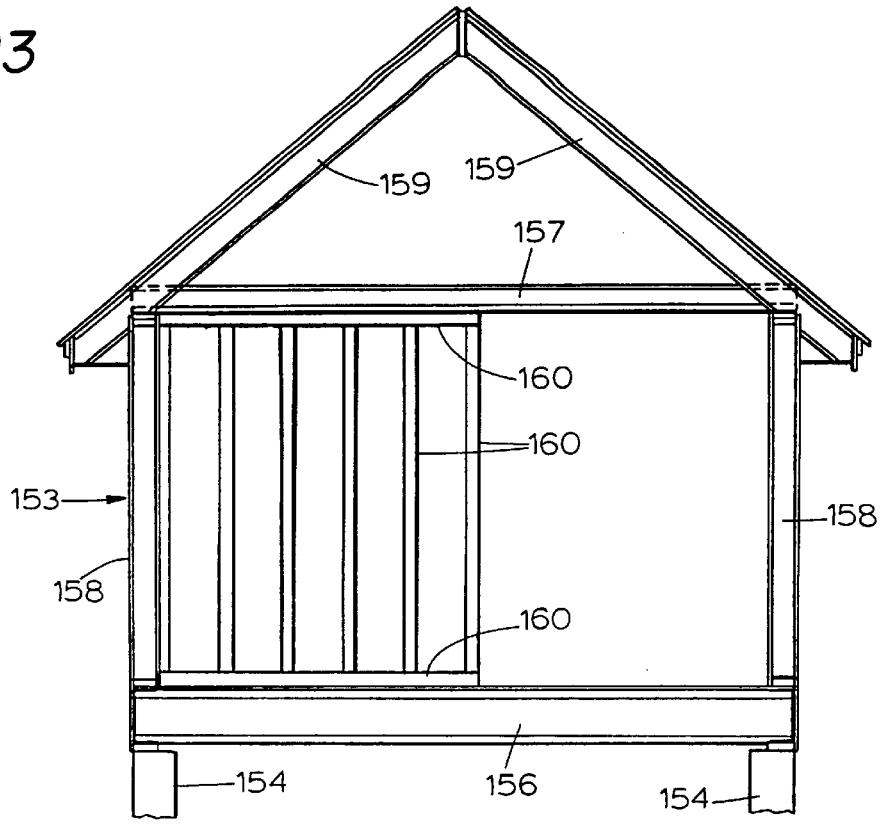
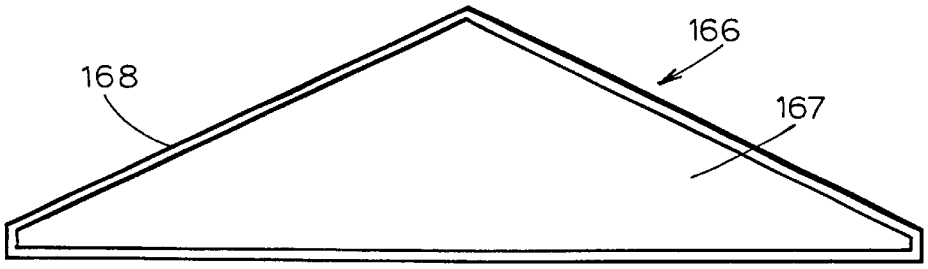
FIG. 24

COMPOSITE STRUCTURAL MEMBER AND WALL ASSEMBLY METHOD

RELATED APPLICATIONS

This application is a continuation of application Ser. No. 08/725,238, filed Oct. 6, 1996 now U.S. Pat. No. 6,061,995, which is a Continuation-In-Part of application Ser. No. 08/610,308 filed Mar. 4, 1996 now abandoned.

FIELD AND BACKGROUND OF THE INVENTION

This invention relates to structural members for use primarily in the construction of houses and other buildings.

A typical building, such as a house, includes a variety of different structural or framing members. Examples are wall studs, floor and ceiling joists, roof rafters, partition wall studs, etc. These members have traditionally been made of wood, although in recent years sheet metal studs have found increasing use.

While wood performs well, it has drawbacks such as increasing scarcity and the resulting higher cost, and it is susceptible to damage from fire, insects and rot. On the other hand, sheet metal structural members conduct heat (or cold) through a wall, and some metal structural members tend to buckle when exposed to high temperatures. Further, many builders are not familiar with the techniques required to build with metal parts.

It is a general object of the present invention to avoid the foregoing disadvantages by providing a structural member and a wall assembly having a reduced cost and reduced susceptibility to thermal conductivity.

SUMMARY OF THE INVENTION

A structural member constructed in accordance with this invention comprises a body part and edge covers which are attached to the body part. The body part is formed by a core formed of a composition including gypsum. The core has opposed edges, and the edge covers extend over the opposed edges.

The invention further comprises a wall assembly including one or more of the above structural members.

BRIEF DESCRIPTION OF THE DRAWINGS

This invention will be better understood from the following detailed description taken in conjunction with the accompanying figures of the drawings, wherein:

FIGS. 17, 18 and 19 illustrate steps in the manufacture of another embodiment of the invention;

FIG. 23 is a diagram of a building including structural members in accordance with the invention;

FIG. 24 is a view of a truss constructed in accordance with the invention;

DETAILED DESCRIPTION

Figure 2:
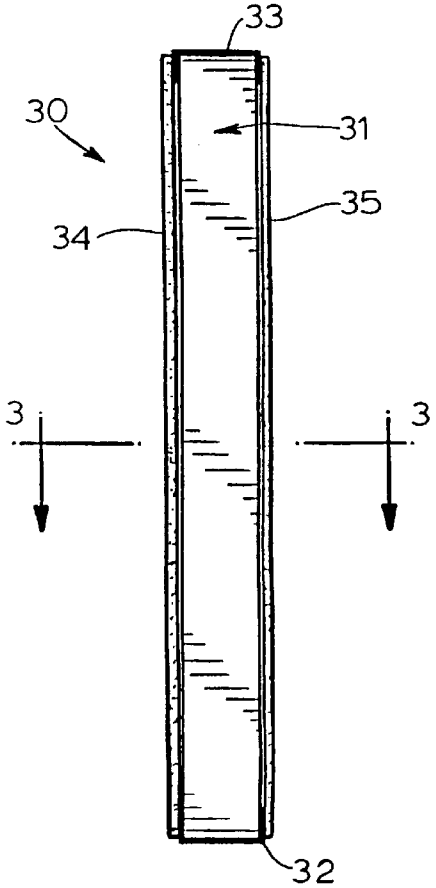
FIG. 2 is an end view of the wall shown in FIG. 1.
Figure 1:
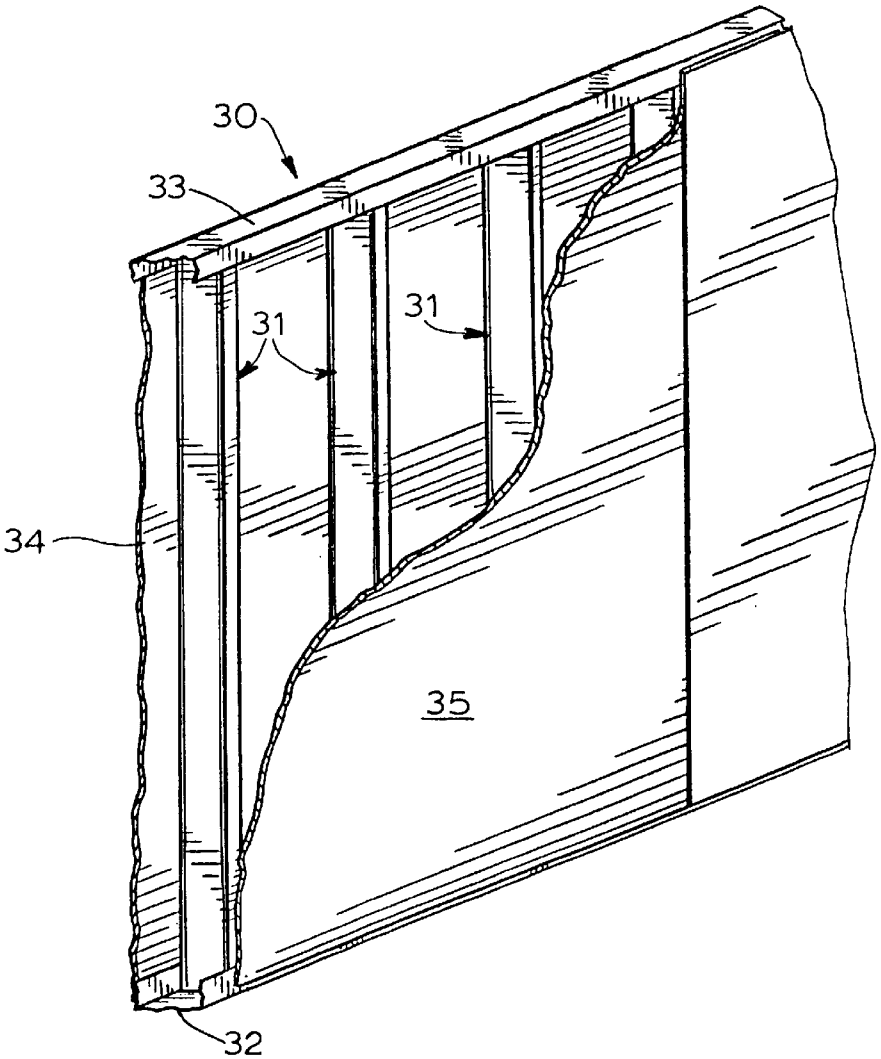
FIG. 1 is a fragmentary perspective view of a wall including structural members constructed in accordance with the present invention.
Figure 3:
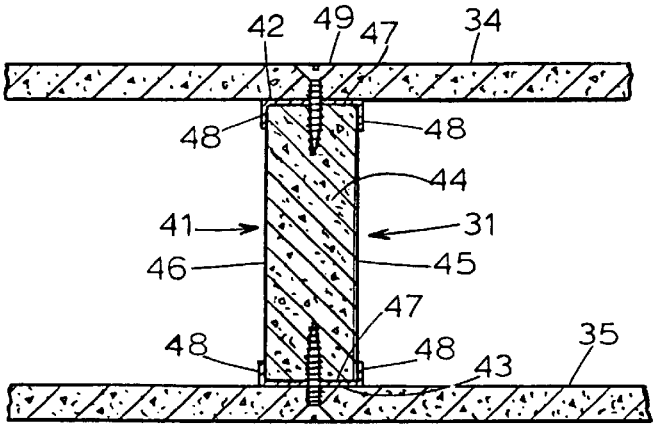
FIG. 3 is an enlarged fragmentary sectional view taken on the line 3—3 of FIG. 2.

With reference first to FIGS. 1 through 3, there is illustrated a wall assembly 30 which may be a partition wall, for example, of a house or other type of building. The wall assembly 30 includes a plurality of vertically extending composite studs 31 constructed in accordance with the present invention which are spaced apart in the horizontal direction. In the present instance, the studs are mounted at their lower ends in a C-shaped metal floor channel 32 and are mounted at their upper ends in a C-shaped metal ceiling channel 33. One side of the channels and the studs 31 is covered by a board 34 of a wall panel and the other side is covered by a board 35 of another wall panel, thereby forming a hollow wall since the studs 31 both separate and support the two wall panels. In the present specific example of the invention, the two boards 34 and 35 are gypsum wallboards. The ends of the vertical studs 31 extend between the flanges of the channels 32 and 33. The parts of the wall assembly 30 are secured together as by screw fasteners which secure the boards 34 and 35 to the edges of the studs 31 and to the flanges of the channels 32 and 33.

Figure 4:
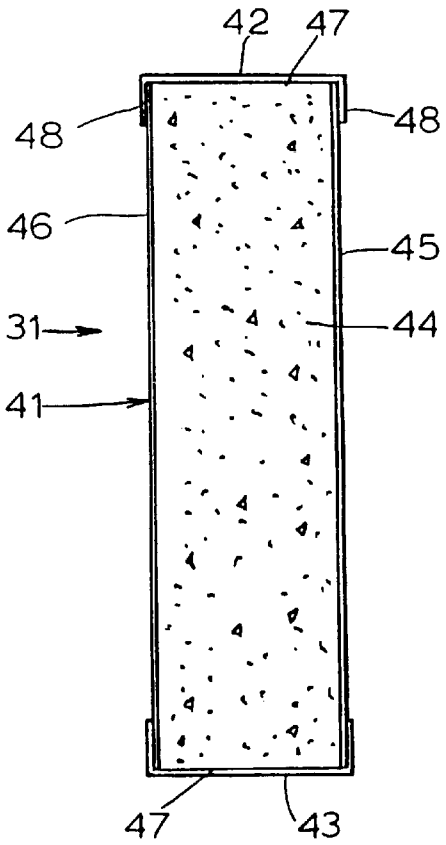
FIG. 4 is a further enlarged sectional view illustrating a structural member shown in FIG. 3.

With specific reference to FIGS. 3 and 4 which show one of the studs 31, the stud 31 comprises a main body 41 and two edge strips 42 and 43. The main body 41 includes a core 44 preferably formed of a composition including gypsum, and cover or backing sheets 45 and 46 secured to the two sides of the core 44. The main body 41 also includes two edges 47 which are covered by the edge strips 42 and 43. In this embodiment of the invention, the strips 42 and 43 are relatively rigid and are made, for example, of sheet metal. In the embodiment of the invention illustrated in FIGS. 1–4, the two strips 42 and 43 cover the edges 47 and each includes flanges 48 which fold or extend over the backing sheets 45 and 46. The strips 42 and 43 are firmly secured to the main body 41, and the boards 34 and 35 are secured to the studs 31 by screw fasteners 49. The fasteners 49 extend through the boards 34 and 35 and self-thread through the strips 42 and 43 and firmly secure the boards 34 and 35 to the strips. Since the strips are, in turn, secured to the main body 41, the boards 34 and 35 are separated by and secured to the studs 31.

As a specific example of the invention shown in FIGS. 1 to 4, the core 44 is made of a composition of gypsum and conventional additives. The composition may be the same as that found in conventional gypsum wallboard or core board. The sides are covered by backing sheets 45 and 46 of the type normally used to cover ordinary gypsum wallboard. The depth of the studs 31, or in other words the distance between the adjacent sides of the boards 34 and 35, is substantially equal to 3-⅝", and the thickness of the studs (the distance between the sheets 45 and 46 ) is substantially 1-¼". These dimensions are the most common size for conventional wall studs. The strips 42 and 43 are made of sheet metal preferably having a thickness between 0.012 inch to 0.020 inch, and the flanges 48 have a length of approximately ¼". The strips 42 and 43 are on the core surfaces which are spaced the farthest distance apart (i.e., farther than the distance between the two sides of the core), and the strips 42 and 43 cover the entire edge surfaces of the core.

The stud 31 constructed in accordance with this invention has a number of advantages. Its cost may be substantially less than the cost of a comparable size wood or metal stud. The main body 41 is relatively fire-resistant and does not conduct heat readily between the two boards 34 and 35. The metal strips 42 and 43 cover and protect the end surfaces of the core 44 and they also form members to which screw fasteners may be firmly secured. The studs may have the size and feel of wood studs and may be handled with essentially the same construction techniques as wood studs.

A wall assembly 30 including studs in accordance with this invention also has good transverse strength, that is, strength in the direction perpendicular to the wall panels. The edge strips 42 and 43 form reinforcement strips which are spaced relatively far apart relative to the bending axis of the stud under a transverse load. Further, the planes of the sheets 45 and 46 on the sides of the studs are parallel to the direction of the transverse load. The core serves to hold the sheets 45 and 46 in these planes, and the sheets have a substantial strength against a load in the direction of these planes.

The stud construction shown in FIGS. 3 and 4 may include a main body formed by a single sheet of gypsum shaft liner, which is normally approximately 1" in thickness. With the addition of the flanges 48, such a stud will have an overall thickness of approximately 1-1/32". Instead, the stud shown in FIGS. 3 and 4 may be formed of a single core having a standard stud size of a thickness of 1-¼" and a width of 3-⅝".

Figure 5:
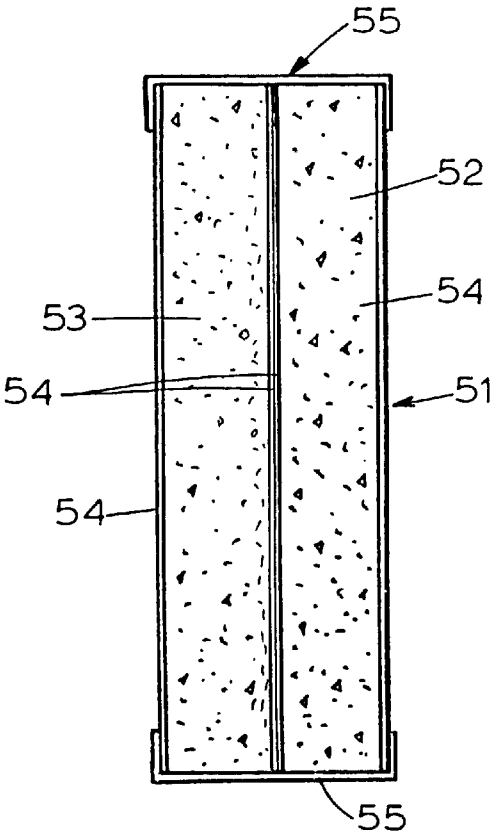
FIG. 5 is a view similar to FIG. 4 but illustrating an alternative construction.

FIG. 5 illustrates a construction wherein the main body of a stud 51 is formed by two layers 52 and 53 of board such as ⅝" gypsum board. Each of the layers 52 and 53 is covered on both sides by backing sheets 54, and the edges are covered by strips 55 which extend across both layers. The adjoining backing sheets 54 of the two layers 52 and 53 may be fastened together by an adhesive, and the strips 55 may be secured to the two layers 52 and 53 by an adhesive.

FIGS. 6 through 13 illustrate different methods of securing the rigid strips to the main body. In each instance, the main body may be formed by a single layer of core material and backing sheets as shown in FIG. 4. or by two layers as illustrated in FIG. 5.

Figure 6:
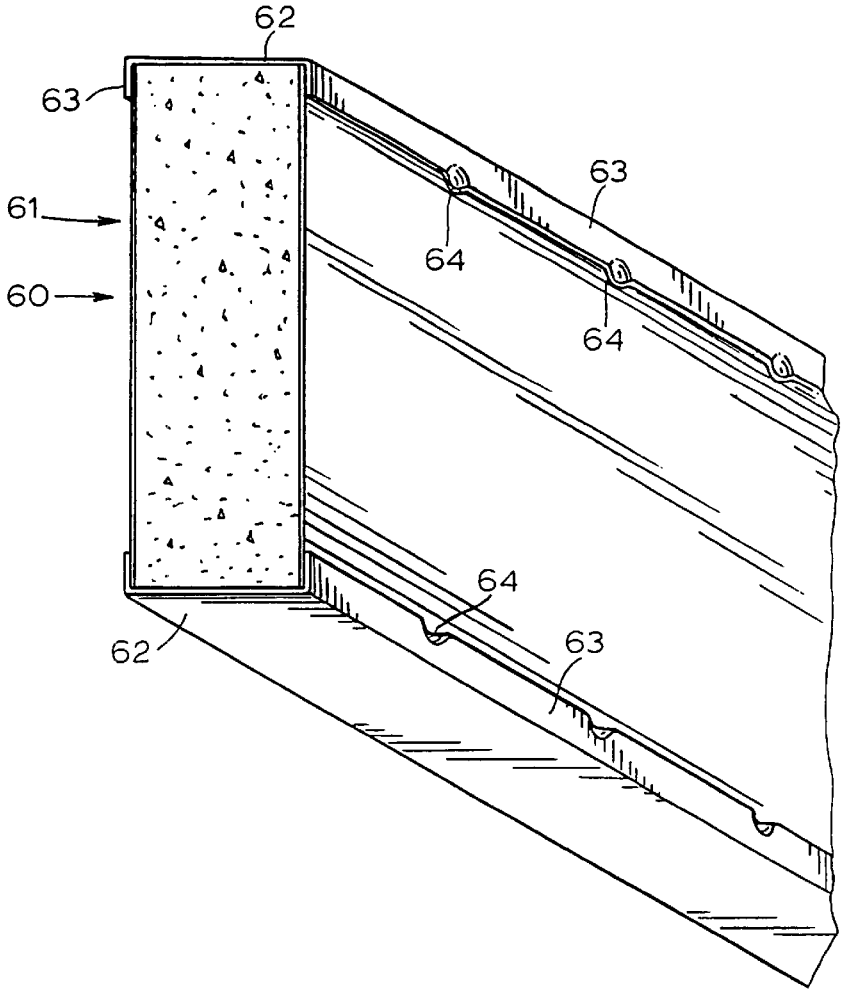
FIG. 6 is a perspective view further illustrating the structural member shown in FIG. 4.

With reference first to FIG. 6, a structural member 60 is illustrated which includes a main body 61 and two edge strips 62. Each of the edge strips 62 includes flanges 63 as previously described, and the flanges 63 are secured to the main body 61 by crimps or indentations 64 at spaced locations along the length of the structural member 60. The crimps or indentations 64 are provided in place of or in addition to an adhesive between the strips and the core and the backing sheets of the main body 61.

Figure 7:
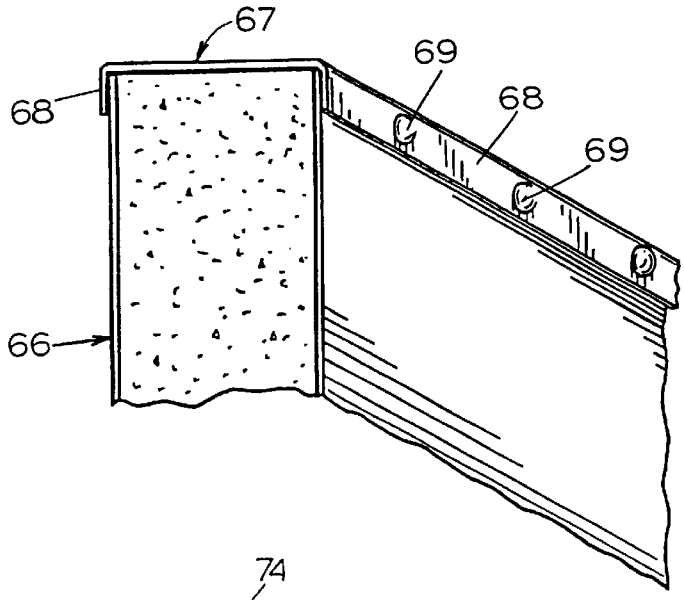
FIGS. 7, 8 and 9 are fragmentary sectional views showing alternative constructions of the structural member.

FIG. 7 illustrates a structural member including a main core 66 and edge strips 67 (only one shown), wherein flanges 68 of the edge strips 67 are secured to the main body 66 by staking as indicated by the numeral 69 at spaced locations along the length of the structural member.

Figure 8:
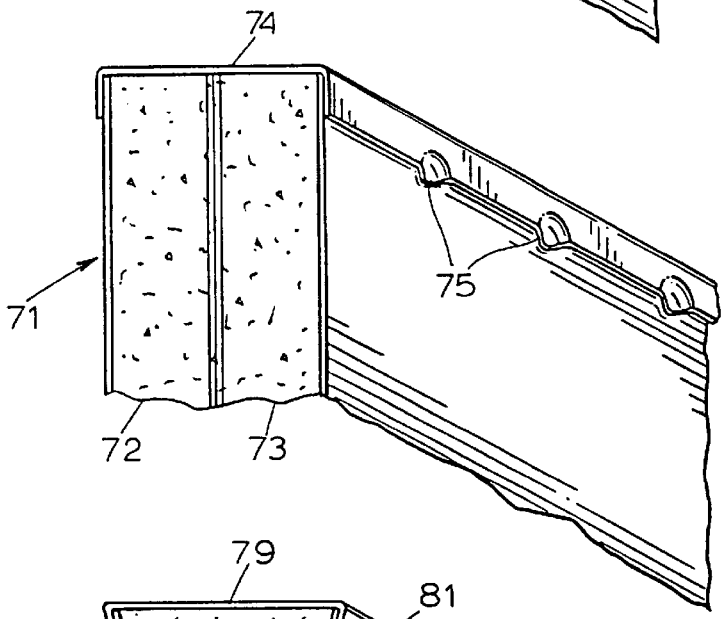

FIG. 8 illustrates a structural member 71 similar to the member 60 shown in FIG. 6. However, it is formed by two layers 72 and 73 instead of a single layer, and by rigid edge strips 74. The edge strips 74 are secured to the two layers 72 and 73 by crimps 75 similar to the structure shown in FIG. 6. The two layers 72 and 73 are preferably glued together and they may be fastened by an adhesive to the edge strips 74.

Figure 9:
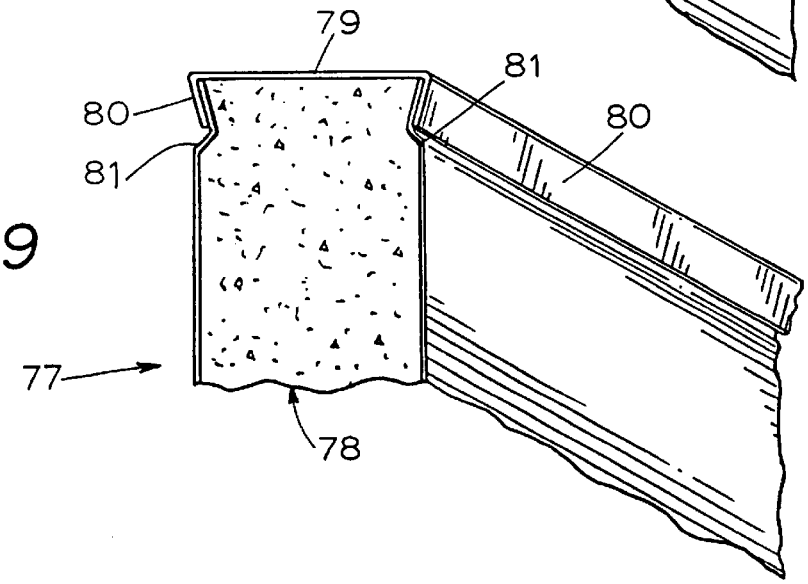

FIG. 9 shows a structural member 77 including a main body 78 and two edge strips 79. Each edge strip 79 includes two flanges 80 which are pressed toward each other and into the sides 81 of the main body 78, thereby securing the edge strips to the main body.

Figure 10:
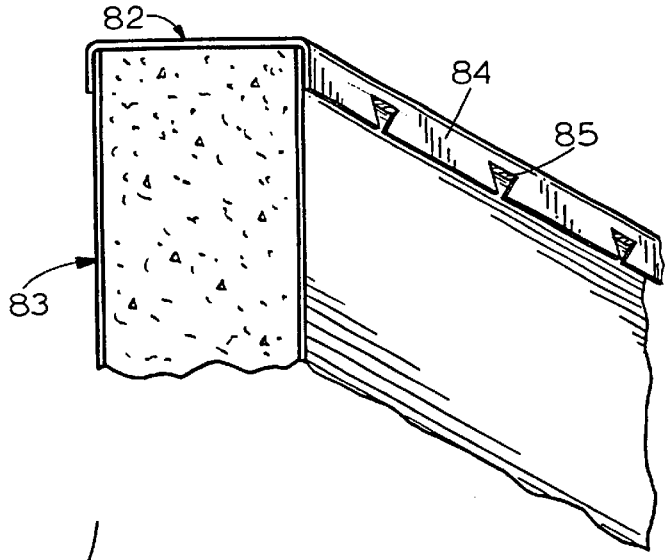
FIG. 10 is a fragmentary sectional view showing still another form of the invention.
Figure 11:
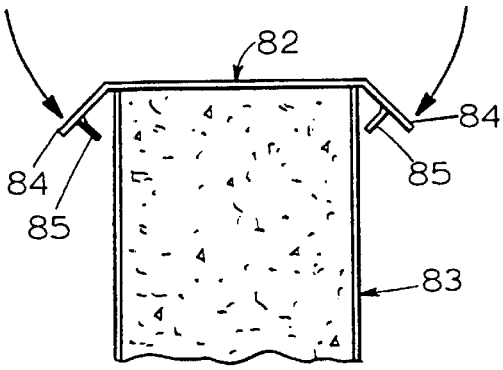
FIG. 11 is a view illustrating the manufacture of the member shown in FIG. 10.

With reference next to FIGS. 10 and 11, two edge strips 82 (only one shown in FIGS. 10 and 11 ) are secured to a main body 83. Each of the edge strips 82 has two flanges 84 and each of the flanges has preformed prongs 85 formed in them at spaced locations. The prongs 85 may be precut by a punching operation. As is shown in FIG. 11, to assemble an edge strip 82 with the main body 83, the center portion of an edge strip 82 is positioned against an edge of the main body and then the flanges 84 are bent downwardly and inwardly to drive the prongs 85 into the main body 83 and secure the edge strip to the main body 83.

Figure 12:
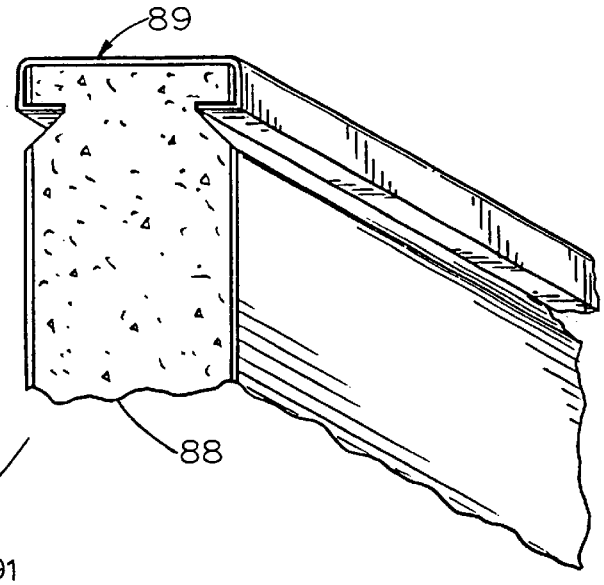
FIGS. 12 and 13 are views similar to FIGS. 10 and 11 but illustrating still another alternative form of the invention.
Figure 13:
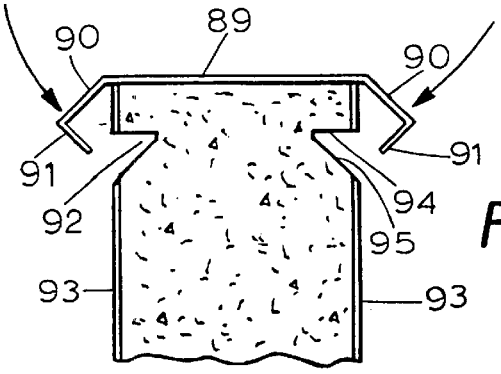

With reference to FIGS. 12 and 13, the main body 88 has edge strips 89 attached to it. Each of the edge strips 89 includes flanges 90 and the flanges have edge portions which are bent inwardly to form flange lips 91. The main body 88 has grooves 92 formed along the sides 93 adjacent the edges of the main body, and the flanges 90 are bent inwardly as best shown in FIG. 13 to cause the flange lips 91 to fold into the grooves 92. Preferably the lips 91 extend at substantially a right angle to the adjacent portions of the flanges 90 and the grooves 92 are shaped to engage the lips 91. Thus, each of the grooves 92 has a surface 94 which is at a right angle to the side 93 and is engaged by the lip 91, and another surface 95 which is sloped or angled to provide clearance for the lip 91 when the flange 90 is bent inwardly.

Figure 14:
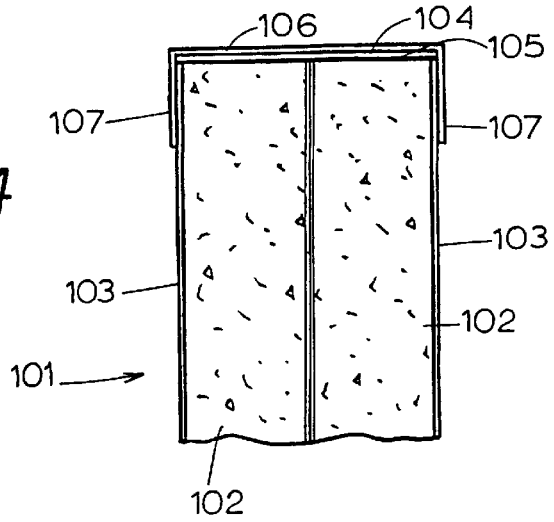
FIGS. 14 and 15 are views illustrating the manufacture of still another embodiment of the invention.
Figure 15:
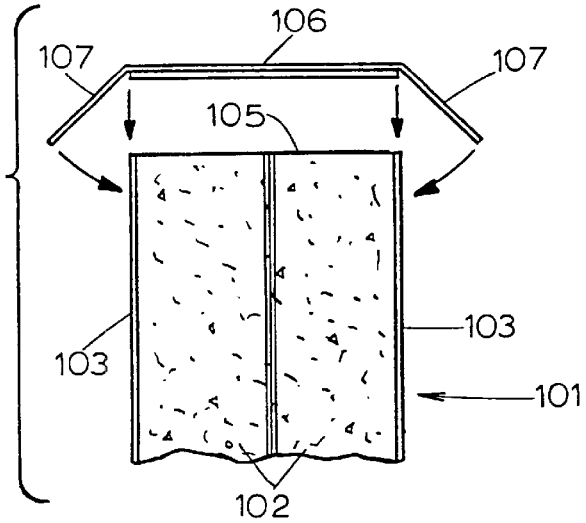

FIGS. 14 and 15 illustrate a construction wherein reinforcement edge strips are secured to a main body by covering them with additional sheets such as the sheet material used on the sides of the core. A structural member 101 formed by two board layers 102 (although a single relatively thick layer may suffice), and each of the boards has backing sheets 103 on both sides. A flat edge reinforcement strip 104 is positioned against the edge 105 (preferably along the entire length of each edge) of the main body 101, and the width of the strip 104 is substantially equal to the overall width of the main body 101. A cover strip 106 is positioned over the strip 104, and the strip 106 is sufficiently wide that it folds over the edges of the strip 104 and onto the outer sides of the layers 102. The folded over portions 107 are securely fastened as by an adhesive to the sheets 103 of backing material, thereby securing the edge strip 104 to the main body 101. As previously described, edge strips 104 and strips 106 are provided along each edge of the main body 101. The cover strips 106 may be made of backing paper or other sheet material.

The strips 104 may be made of various reinforcement materials such as metal (as previously mentioned), paper, cardboard, nonwoven fibers, etc.

Figure 16:
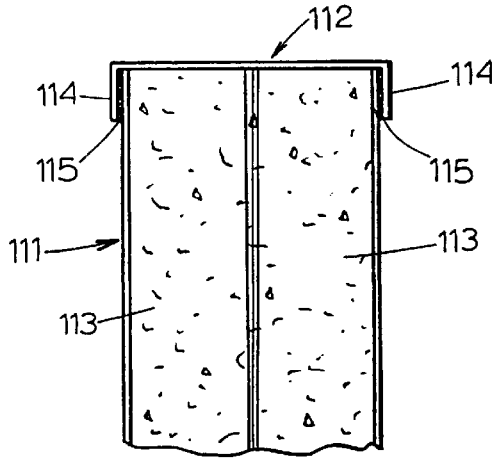
FIG. 16 is a view illustrating another embodiment of the invention.

FIG. 16 illustrates a structural member including a main body 111 and edge strips 112 secured to opposed edges of the main body. In this instance, two layers 112 of board are secured together to form the main body. Each edge strip 112 includes a downwardly bent flange 114 and layers 115 of adhesive secure the flanges 114 to the outer backing sheets of the layers 113. In this instance, the center portion of each edge strip (that is the portion. of the edge strip between the two flanges 114 ) may not be secured to the main body 111.

In the foregoing described embodiments of the invention, the edge strips are secured to one or more layers of core material, after the core material has been formed. Normally the layers have been cut or formed into long strips. In the embodiments shown in FIGS. 17 through 22, the core material of the main body may be extruded or cast in place and secured to the backing sheets and to the edge strips before it has set. With reference first to FIGS. 17 to 19, a structural member 120 is formed by a core 121, two backing sheets 122 and 123 and two edge strips 124 as described in connection with the strips 104 in FIGS. 14 and 15. The core 121 is made, for example, of gypsum and may be cast in place or extruded in the shape shown in FIG. 17. After the core 121 has been formed of a gypsum slurry but before the gypsum has set by passing through a drying stage, the two strips 124 are positioned against the edge surfaces 126 and then the backing sheet 122 is folded over one side 127 of the core, over the two strips 124, and then over at least part of the other side 128 of the core. The second backing sheet 123 is then positioned against the side 128 and overlies the folded edge portions of the sheet 122. After the parts have been assembled and are in the condition shown in FIG. 19, the assembly is moved through a drying kiln to produce the resulting structural member. The backing sheet 122 may be sufficiently wide that it completely envelopes the core 121, thereby eliminating the need for the second sheet 123.

Figure 20:
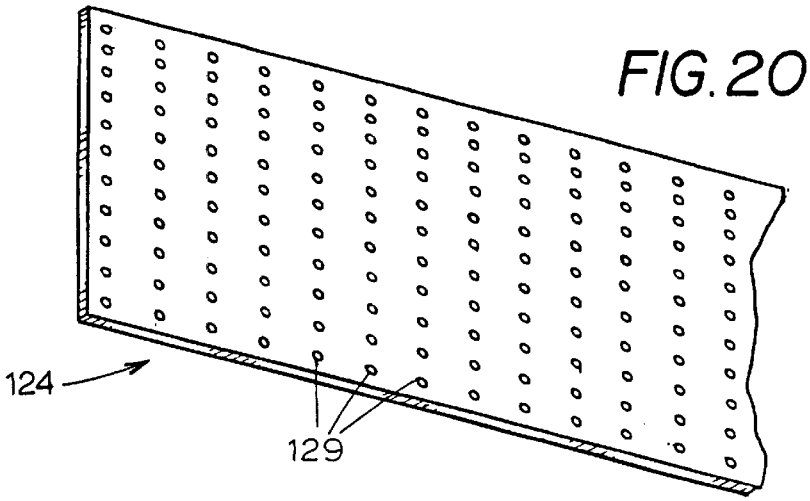
FIG. 20 is a view of a part of the structural member shown in FIGS. 17 through 19.

With reference to FIG. 20, the edge strips 124 may include a plurality of perforations 129 which extend through the strips. The perforations 129 permit the slurry, used in forming the core 121 in the process described in connection with FIGS. 17 to 19, to pass through and engage the backing sheet 122 and attain a better attachment with the backing sheet at the edges of the member.

Figure 21:
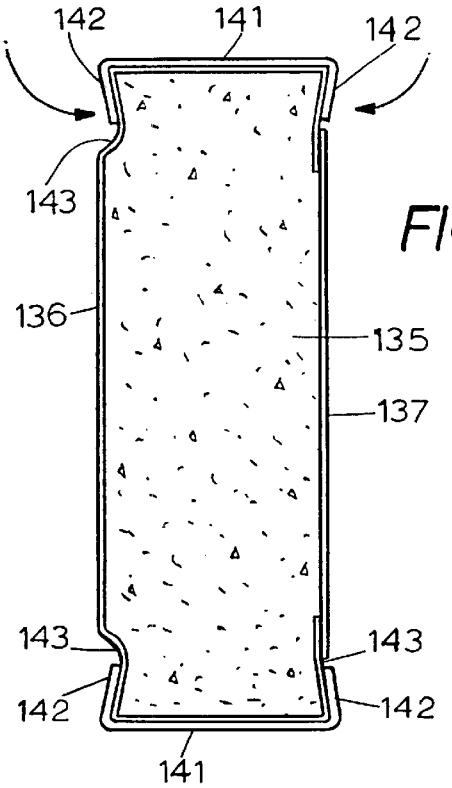
FIG. 21 is a view of another embodiment of the invention.
Figure 22:
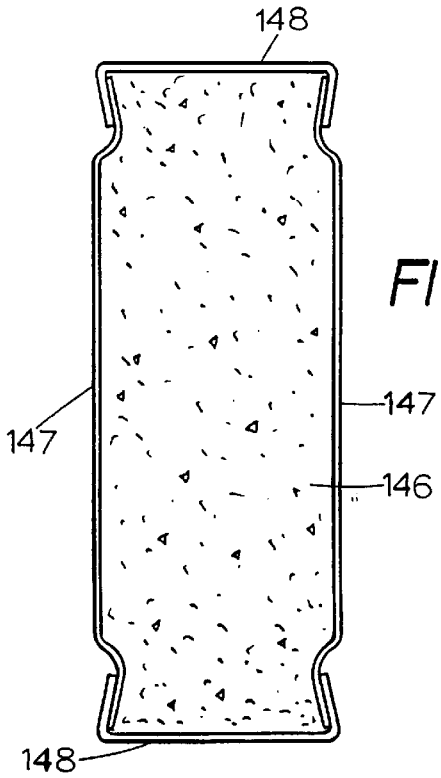
FIG. 22 is a sectional view of still another embodiment of the invention.

FIGS. 21 and 22 also show two embodiments where the backing sheets and the edge strips are secured to the core and backing sheets before the core slurry has finally set. In FIG. 21, a core 135 of, for example, gypsum slurry is formed and a backing sheet 136 is folded around one side, the edges and over a portion of the opposite side. A second backing sheet 137 is then applied to the other side of the core. The backing sheets are, of course, similar to those shown in FIG. 17–19. Extending along the edges of the core are two edge strips 141 (preferably made of a rigid material such as metal or plastic) which have flanges 142. The flanges 142 angle inwardly and they extend into indentations 143 in the core 135 and the backing sheet 136, thereby forming a firm connection between the edge strips 141 and the core 135. The flanges 142 may be initially angled inwardly as shown in FIG. 21 before the core slurry is poured into the backing paper, or the flanges may be bent inwardly and the indentations 143 formed after the core slurry has been poured. Instead of two sheets 136 and 137 of backing paper, a single sheet may be provided, having a width sufficiently wide that the edges overlap and form an envelope around the core. In this embodiment, the portions of the sheet 136 which extend across the edges of the core 135 also form reinforcement edge strips.

FIG. 22 shows a structural member similar to that shown in FIG. 21 and includes a core 146 having backing sheets 147 along opposite sides, and edge strips 148 along the opposed edges. The structural member shown in FIG. 22 is, of course, similar to the member shown in FIG. 21 except that the backing sheets do not extend across the edges of the core and underneath the rigid strips 141.

Figure 25:
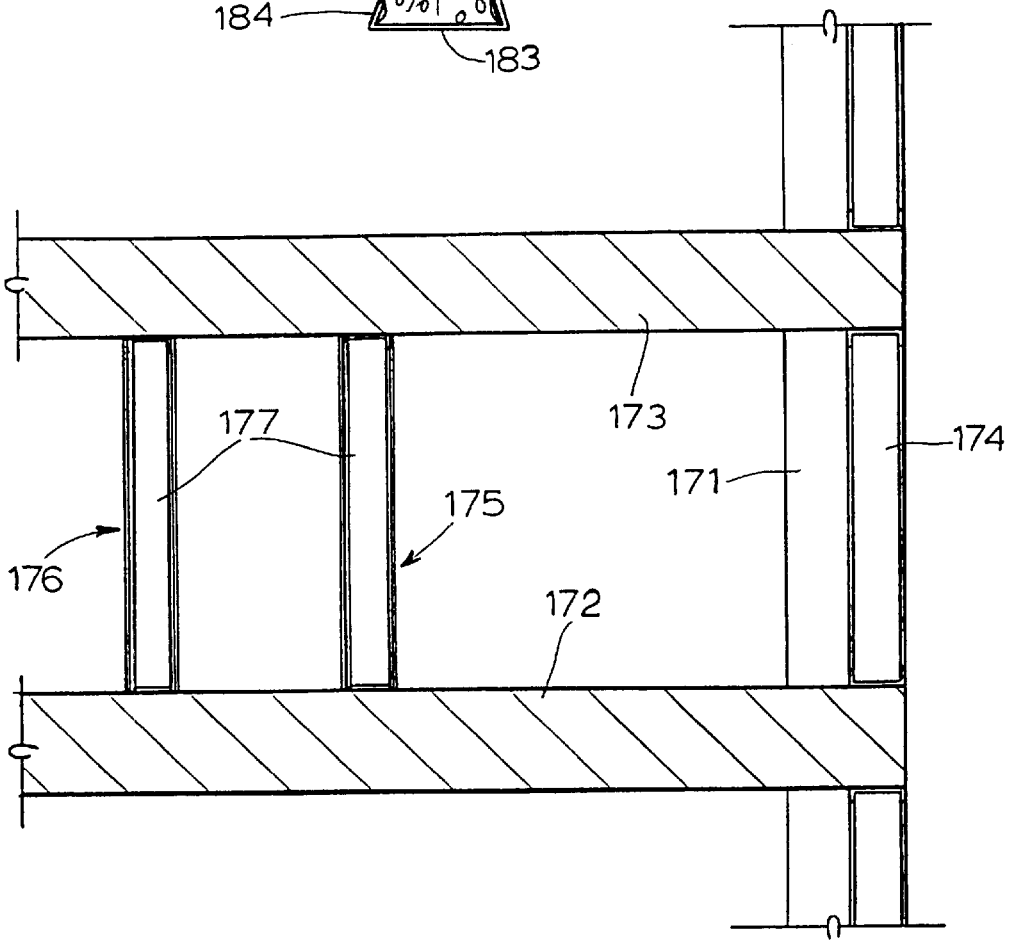
FIG. 25 is a sectional view of another building including structural members in accordance with the invention.

FIGS. 23, 24 and 25 illustrate additional structural members incorporating the present invention. With regard to FIG. 23, a cutaway view of a house 153 mounted on a foundation 154 is illustrated. The house includes load carrying floor joists 156, ceiling joists 157, wall studs 158, roof rafters 159, and studs 160 forming an interior partition. All of the members 156–160 may be formed by composite structural members in accordance with the present invention. The floor and ceiling joists and the roof rafters 159 preferably have increased cross-sectional dimensions sufficient to withstand the structural forces imposed on them.

FIG. 24 illustrates a truss 166 which may be particularly useful in a manufactured home, for example. The truss 166 is formed by a single panel forming a main body 167 shown in FIG. 3. The peripheral edges of the main body 167 have edge strips 168 secured to them, the edge strips preferably being rigid so that other parts of the structure may be secured by screw fasteners to the truss 166. While the main body 167 as illustrated is imperforate, it may include openings for utilities such as conduits and wires. It should be noted that the wall studs and other structural members described herein may have openings preformed through the main body to receive wires, etc.

FIG. 25 illustrates a section of a rather large building including vertical columns 171 and horizontal floor and ceiling slabs 172 and 173. Curtain walls 174 are mounted at the exterior of the building. Reference numerals 175 and 176 indicate partition walls including wall studs 177 constructed in accordance with the present invention. Since the walls 175 and 176 function to divide or separate the interior space on a floor of the building and are not load bearing, the core of the structural members may be formed of a relatively lightweight material such as lightweight gypsum. Load bearing refers to a load parallel to the long length of a stud; such a stud will normally bear a transverse load, that is, a load which is substantially perpendicular to the long length of the stud. The curtain wall 174 is also not load bearing and may be structured in accordance with this invention.

Figure 26:
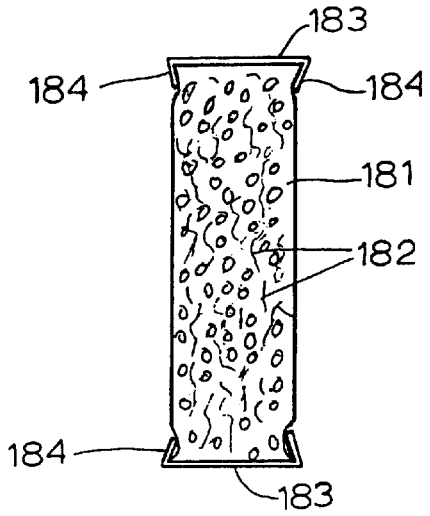
FIG. 26 is a view of another structural member in accordance with this invention.

In the previously described embodiments of the invention, the main body of the structural members includes a core at least partially covered by at least one backing sheet. FIG. 26 illustrates an embodiment of the invention wherein the core 181 forming the main body has sufficient structural integrity that exterior backing sheets are not needed. For example, the core 181 may be made of a gypsum-cement composition, or it may be made of gypsum with a fiber filler or binder. In FIG. 26, the number 182 indicates the strands of a fiber such as the paper fiber normally used in the above described backing sheets. In such an instance, backing sheets are included in the main body but are incorporated as fibers within the core material. The core 181 is secured to edge strips 183 made, for example, of sheet metal. The strips 183 include inwardly angled flanges 184. The member shown in FIG. 26 is preferably constructed by casting the core 181 in place between the flanges 184.

Figure 27:
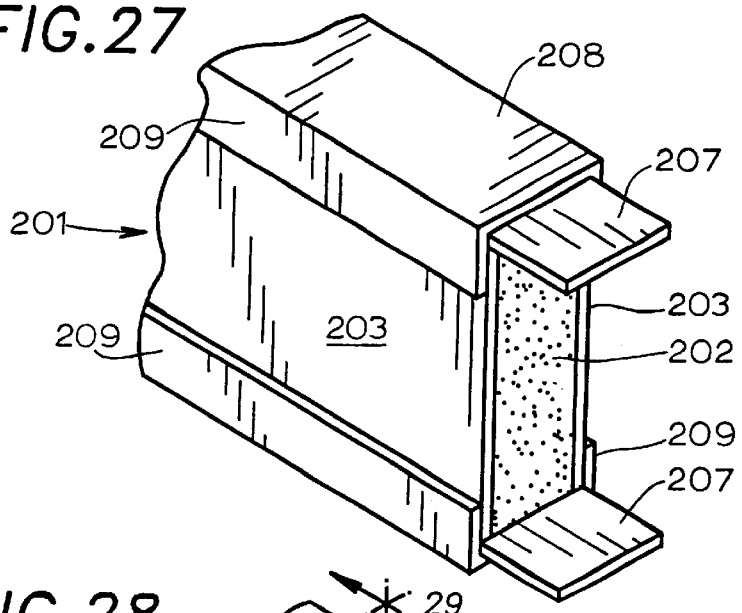
FIG. 27 is a perspective view of another structural member in accordance with the invention.
Figure 28:
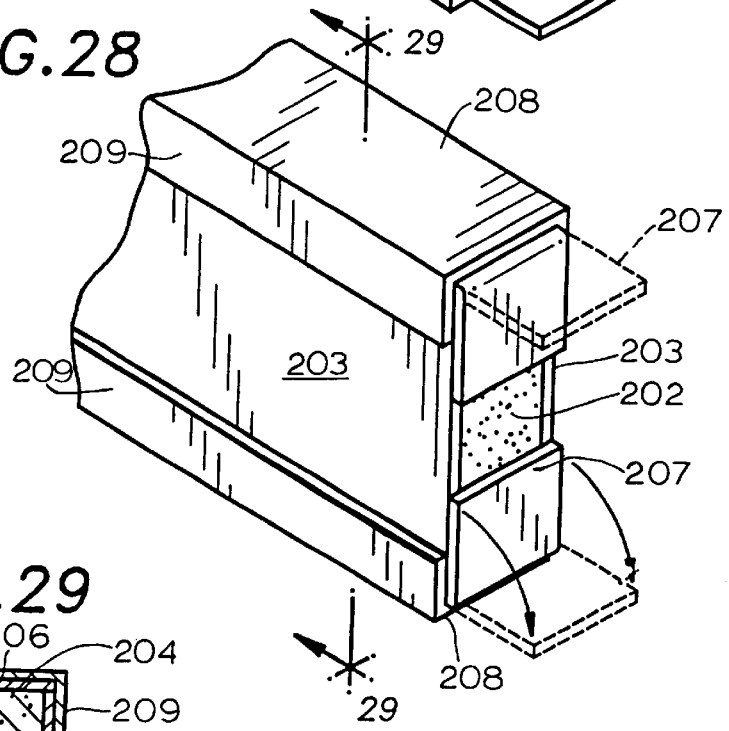
FIG. 28 is a view similar to FIG. 27 and showing different positions of some of the parts of the member of FIG. 27.
Figure 29:
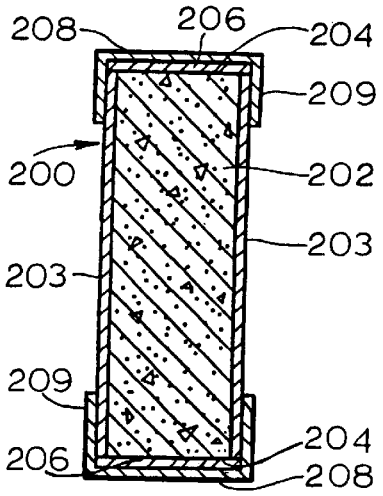
FIG. 29 is a sectional view taken on the line 29—29 of FIG. 28.

FIGS. 27 to 28 and 29 illustrate another structural member 200 (such as a stud) in accordance with another embodiment of the invention. It should be understood that the drawings are diagrammatic and are not intended to be accurate scale drawings, and this is particularly true of the representation of the thicknesses of the parts. This structural member includes a main body 201 comprised of a core 202 made of a gypsum composition, the core 202 having -opposing sides covered by fibrous sheets such as paper. The core 202 is rectangular in shape and may have, for example, the dimensions of a standard size wooden stud used in the manufacture of homes and manufactured housing. The core 202 has two opposed edges 204 (FIG. 29) covered by reinforcement inserts 206 made of a relatively strong material such as sheet metal. The reinforcement inserts 206 extend along the entire opposed extreme edges 206 of the core 202, and the inserts 206 include extensions 207 which extend beyond the ends of the core 202 (see FIG. 27). Extensions 207 may be provided at both or one end of the core 202 and preferably an extension 207 is provided at each of the edges 204.

The structural member 204 further includes a cover 208 (made, for example, of paper) which extends over the reinforcement insert along each of the core edges 204. The covers 208 include flange portions 209 which are folded along the sides of the core and cover the edges of the side covers 203. The covers 208 are secured to the sheets 203 as by an adhesive between the flanges 209 and the side sheets 203.

Figure 30:
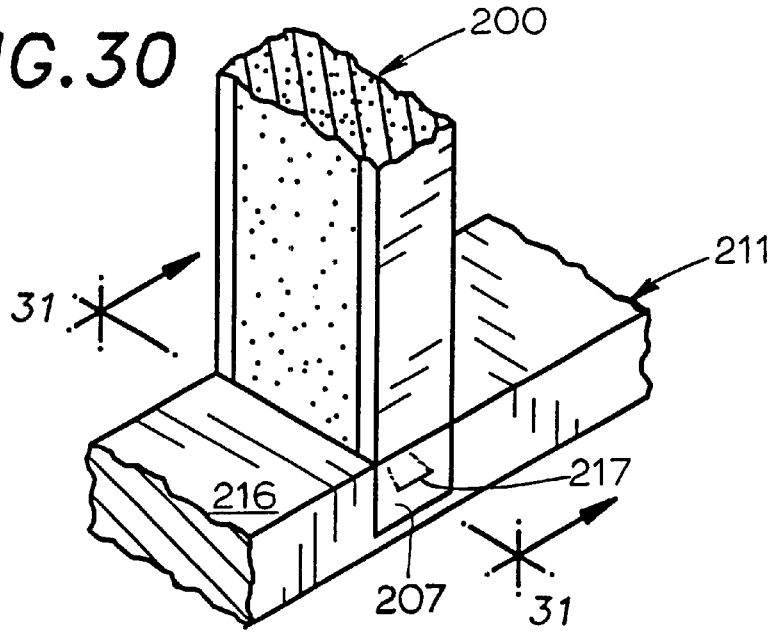
FIG. 30 shows an assembly including a member shown in FIG. 27.
Figure 31:
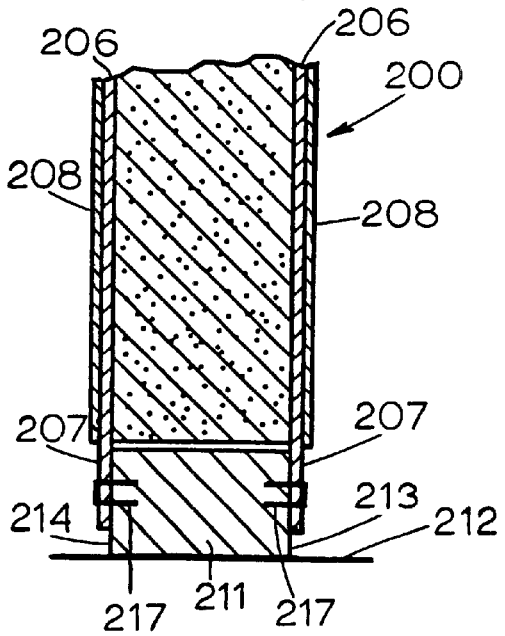
FIG. 31 is a sectional view taken on the line 31—31 of FIG. 30.

FIGS. 30 and 31 illustrate a method of assembling a wall including a vertical stud having the construction shown in FIGS. 27 to 29 and a wooden framing number 211. The framing member 211 is fastened to a floor section (indicated by the numeral 212 in FIG. 31) by suitable means, and the stud extends vertically upwardly from the horizontal framing member 211. The stud 200 is positioned with the two extensions 207 extending downwardly across the front and rear sides 213 and 214, the end of the body member 201 being positioned on the upper side 216 and extending upwardly from the framing member 211. The two extensions 207 are then secured to the sides 213 and 214 by suitable fasteners such as staples, nails or screws indicated generally by the reference numeral 217 in FIGS. 30 and 31. In such a construction, panels (not shown) of gypsum wallboards are positioned on opposite sides of the framing member 211 and the studs 200 and secured to them by means such as metal fasteners and/or an adhesive between the wallboards and the studs 200. The reinforcement inserts 206 thus form reinforcements along the edges of the stud, and serve to enable screw-type fasteners to be secured to the stud in the situation where the reinforcement inserts are made of a strong sturdy material such as metal, and they serve as a fastener for securing the stud 200 to the framing member 211.

With reference to FIG. 28, the extensions 207 are shown extending parallel to the edges 204 of the core, as shown in dashed lines, and they are also shown folded against the edges 204 of the core. The folded position shown in solid lines of the extensions in FIG. 28 are advantageous when the studs are being shipped or stored, and they can be folded outwardly to the positions shown in dashed lines in FIG. 28 and solid lines in FIG. 27 when in use.

Figure 32:
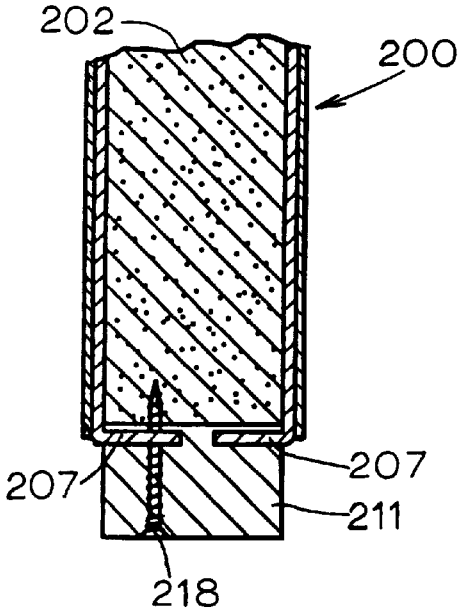
FIG. 32 is a view similar to FIG. 31 and showing a variation of the assembly.

With reference to FIG. 32, the stud 200 is shown with the extensions 207 folded against the bottom end of the core 202. The extensions 207 may be folded straight outwardly as shown by the dashed lines in FIG. 28 for fastening to the framing member 211 in the manner illustrated in FIG. 31, or the stud 200 may be secured to a framing member 211 as shown in FIG. 32 wherein screw fasteners 218 extend vertically through the framing member 211 and through the extensions 207 and into the core 202, in order to secure the stud 200 to the framing member 211.

Figure 33:
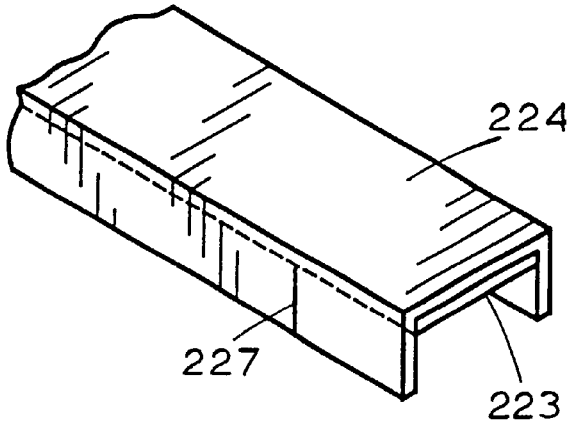
FIGS. 33 and 34 are perspective views showing another embodiment of the structural member.
Figure 34:
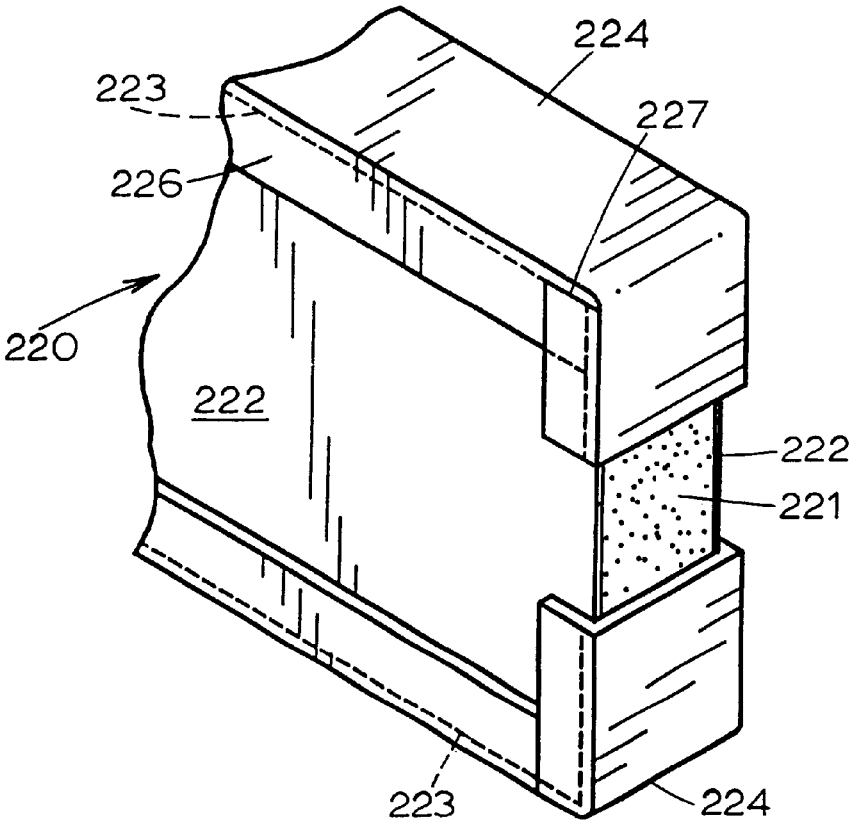

FIG. 34 shows a stud 220 which is generally similar to the stud 200. The stud 220 includes a gypsum core 221 covered on opposite side faces by paper sheets 222. Extending along the edges of the core 221 are strips of reinforcement inserts 223 (better shown in FIG. 33) which are structured similarly to the reinforcement inserts 206 shown in FIGS. 27–29. The reinforcement inserts 223 extend beyond the ends of the core 221 and the entire length of each reinforcement insert 223 is covered by a cover 224. Whereas in FIG. 1, the covers 208 terminate at the end surface of the core 202, in the embodiment shown in FIGS. 33 and 34 the covers extend beyond the end face of the core 221 and extend to the ends of the two extensions 223. To enable the extensions 223 and the portions of the paper covers that are on it to be folded for storage or for mounting on a framing member as shown in FIG. 32, the flanges 226 of. the two covers 224 are preferably sheared along the lines 227, as best shown in FIG. 33, so that the extensions with the covers thereon may be neatly folded against the end surfaces of the core 221 as illustrated in FIG. 34. The reinforcement inserts 206 may be made of a rigid material (such as metal) which will hold a screw or of another strong material such as paper, cardboard, scrim, etc., and the covers 208 may be made of strong backing paper.

Figure 35:
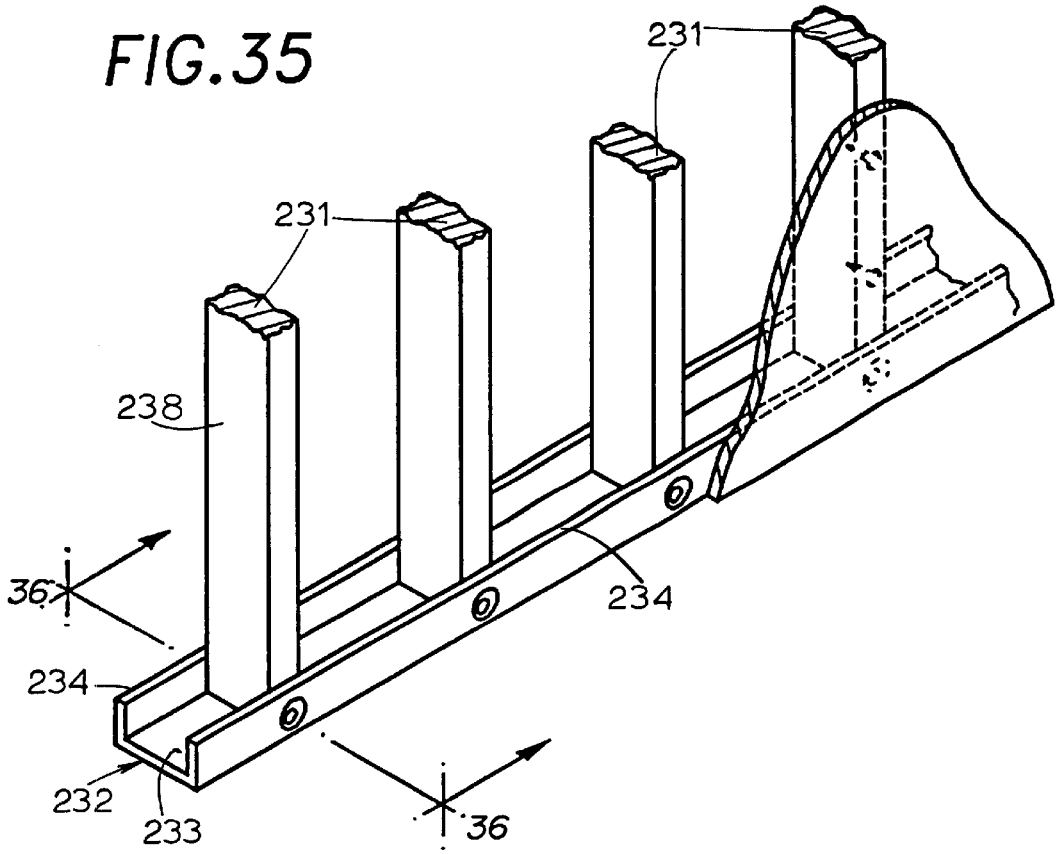
FIG. 35 is a perspective view of a wall assembly including structural members according to the invention.
Figure 36:
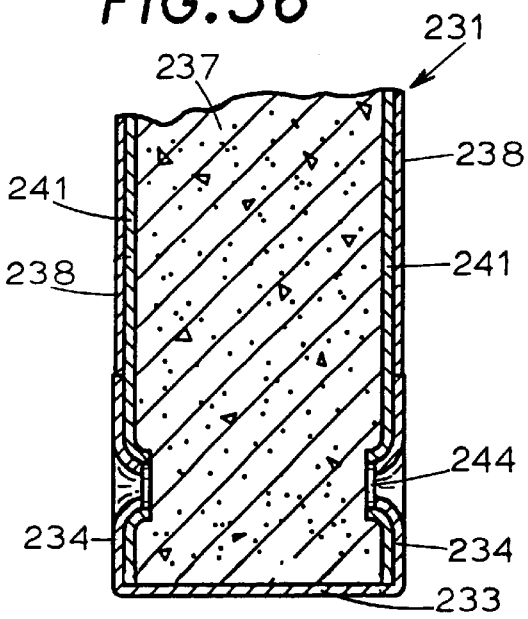
FIG. 36 is a sectional view taken on the line 36—36 of FIG. 35.

FIGS. 35 and 36 illustrate a portion of a wall assembly or structure including a plurality of studs 231. Extending along the bottom ends of the studs 231 is a C-shaped metal track 232 having a horizontal web 233 and vertical flanges 234. Another track (not shown) similar to the C-shaped track 232 is preferably provided along the upper ends of the studs 231 and is fastened to the ceiling, the ceiling and the upper track not being shown in the drawings but being of a conventional nature.

With reference to FIG. 36, each of the studs 231 includes a gypsum core 237 which is covered on its sides by sheets 238 (FIG. 35) as illustrated in FIG. 27, for example. Along the front and back edges of the core 237 are mounted reinforcement inserts 241 which are secured to the core 237 and to the sheets 238 as by an adhesive.

To secure the studs 231 to the track 232 (see FIG. 36), the lower end of each stud 231 is positioned between the flanges 234 and against the web 233 of the channel 232. The width of each of the studs 231 is sized relative to the distance between the flanges 234 such that there is a close fit between the flanges 234 and the reinforcement inserts 241. The parts are then secured together as by a screw-type fastener (not illustrated) extending through the flanges 234 and through the reinforcement inserts and into the gypsum core 237, or by staking the parts together in the areas indicated by the numeral 243 in FIG. 36. Staking may be accomplished by a tool, such as a punch, which is driven through the flanges 234 and through the reinforcement inserts 241 and into the core, whereby the metal of the flanges 234 is offset into an opening 244 in the reinforcement 241. As previously mentioned, instead of staking, the parts may be secured together by screws.

Figure 37:
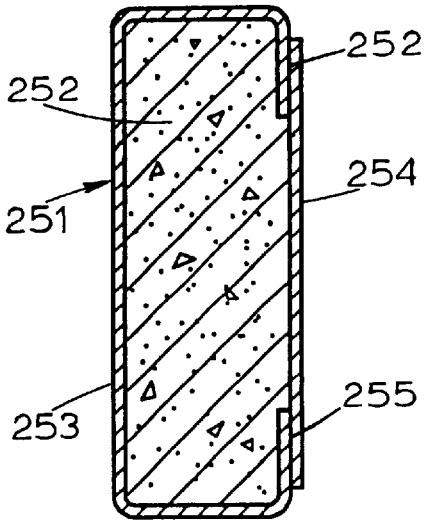
FIGS. 37, 38, 39 and 40 are sectional views of additional embodiments of the structural member.
Figure 38:
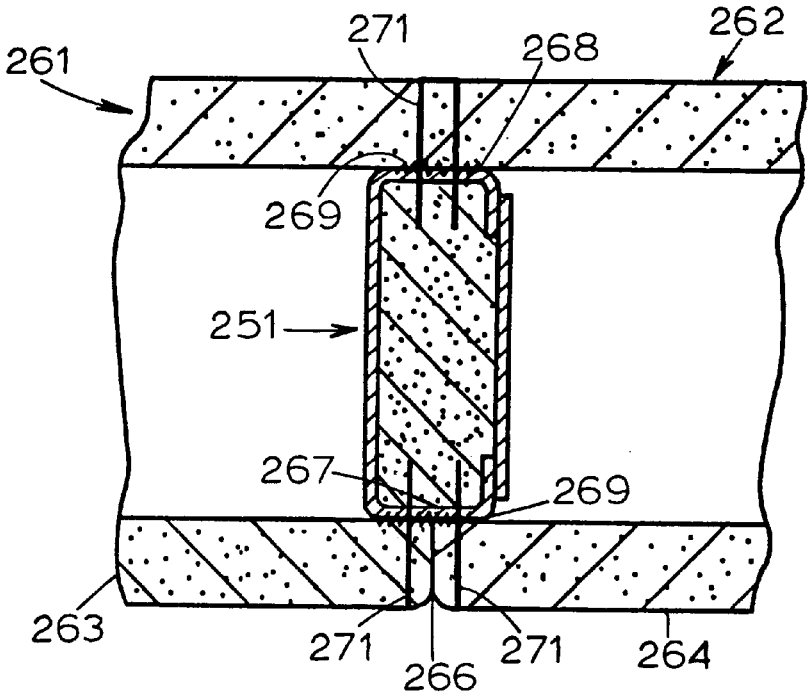
Figure 39:
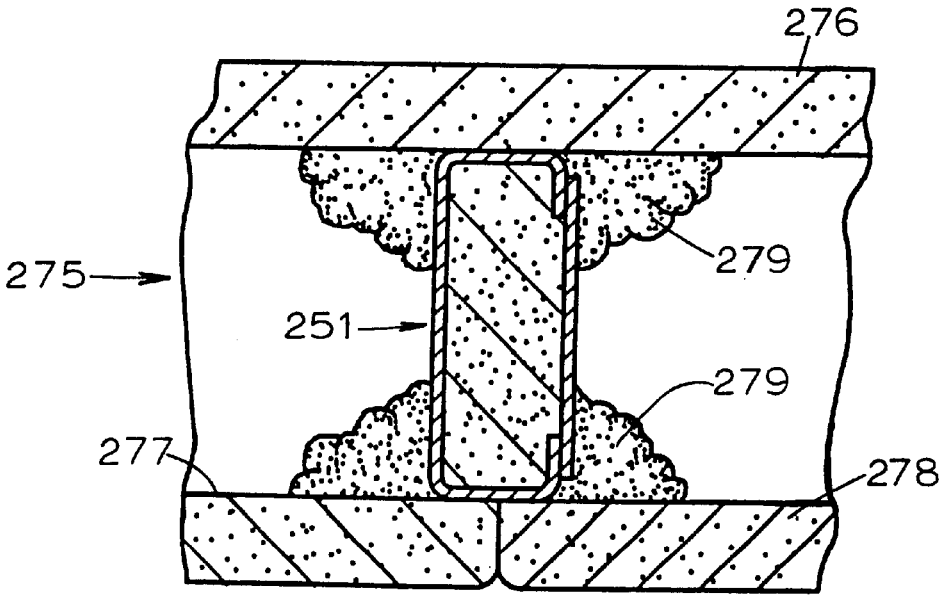

FIGS. 38 and 39 illustrate a wall assembly which is particularly useful in the manufactured housing industry, and FIG. 37 illustrates a stud included in the wall assembly shown in FIGS. 38 and 39. With reference first to FIG. 37, which shows a cross section through a stud 251, the stud includes a core 252 made of gypsum, the core 252 being partially encircled or enclosed by a sheet 253 of paper of the type normally used to cover the sides of gypsum wallboard. The fourth side of the core 252 is covered by a separate sheet 254 which covers the fourth side and overlaps, as indicated at 255, the adjacent edge portions of the sheet 253. Thus, the core 252 is enclosed or enveloped in paper with the exception of the ends of the stud. The core 252 could, however, be enveloped by a single sheet of paper.

With reference to FIG. 38, a wall assembly 261 includes a plurality of the studs 251, the studs 251 extending vertically and being spaced apart in the horizontal direction. Forming one side of the wall assembly 261 is a panel 262 formed by gypsum wallboard, and extending across the opposite side of the wall assembly 261 are additional sheets 263 and 264 of gypsum wallboard which form another panel. The two sheets 263 and 264 are parallel and abut each other at a junction line 266, and one vertical edge 267 of the stud 251 is located at the junction line 266 between the two boards 263 and 264. The board 261 is offset from the two boards 263 and 264 so that the stud 251 is at a junction or joining line 266 on only one side of the wall, the other edge 268 of the stud 251 being intermediate the vertical side edges of the board 262. An adhesive 269 is placed between the vertical edges 267 and 268 of the stud 251 and the adjacent surfaces of the wallboards 261, 263 and 264, and the adhesive 269 secures the parts together. To hold the parts in opposition while the adhesive sets, fasteners such as staples 271 are provided between the wallboards and the studs.

FIG. 39 illustrates a wall assembly 275 which is generally similar to the wall assembly 261, and includes a structural member such as the stud 251 and wallboards 276–278. Instead of securing the parts together by the adhesive 269, in FIG. 39 the parts are secured together by a foam adhesive 279.

Figure 41:
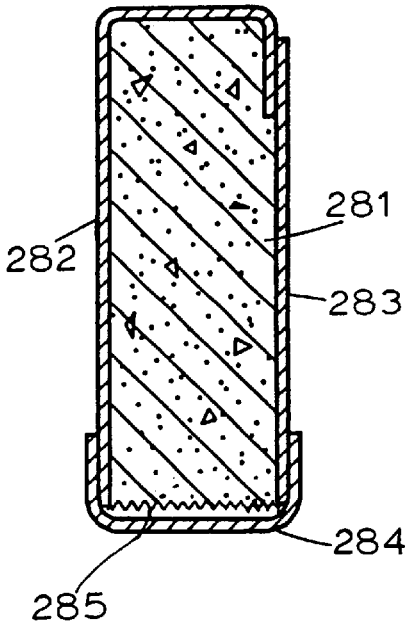
FIG. 41 is a sectional view of another wall assembly according to the invention.

With reference to FIG. 41, an alternative structure of the stud is provided which is cut from a wide sheet of gypsum board, whereas the structure shown in FIG. 37 may be molded to the shape shown in FIG. 37. The stud of FIG. 41 includes gypsum core 281 covered by side sheets 282 and 283 and by a cap made of paper 284 which covers the cut edge 285 of the core.

Figure 40:
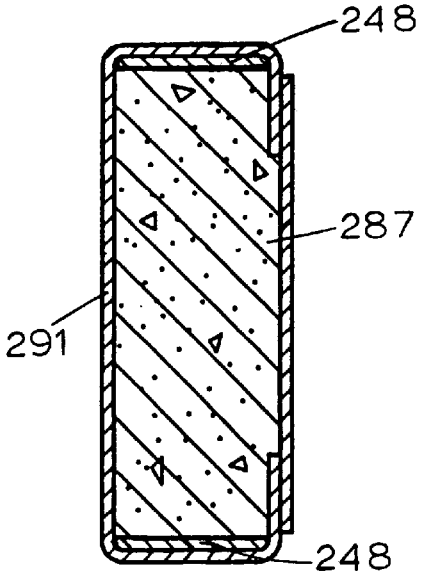

FIG. 40 shows a stud similar to that of FIG. 37 except that reinforcement strips 248 are provided along the edges of the core 289 and underneath the cover 291.

Figure 42:
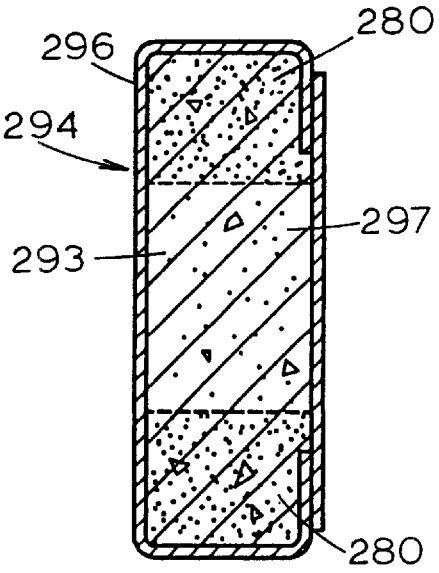
FIG. 42 is a view similar to FIG. 41 and showing still another embodiment of the wall assembly.

In FIG. 42, a core 293 of a stud 294 is covered by paper 296. The core 293 may have portions of different compositions such as low density gypsum 297 and a high density gypsum 280 along the edges of the stud. The core may also be formed of other materials providing extra strength or fire or moisture resistance, if desired, to meet different circumstances.

Structural members incorporating the present invention may have cores made from a variety of different materials in addition to gypsum, such as gypsum-cement compositions, standard weight or lightweight gypsum, recycled gypsum, a moisture-resistant gypsum core, or combinations of such compositions may be used. Further, various fillers, such as wood chips and/or volcanic material, may also be included. The backing sheets may also be made of a variety of different materials, so long as the material has good shear resistance, such as paper, or paper treated for moisture resistance, sheets of woven fiber, etc. The reinforcement edge strips may be made of a variety of materials such as paper, nonwoven (scrim) or woven fibers and metal.

In tests conducted on structures including studs constructed in accordance with this invention, and on prior art stud constructions, the studs of this invention performed comparable to or better than prior art studs; however, the costs of manufacturing structures and studs according to this invention are less than the costs of prior art structures.

The following are fire test results involving different structures:

FIRE TESTS

| TEST NO. | STUDS | WALLBOARD | ENDURANCE IMPROVEMENT (IN TIME) OVER STANDARD |
|---|---|---|---|
| 1. | 1 ¼" × 3 ⅝" 25 ga. HDGL steel stud | ⅝" type FSW | STANDARD - 1 HR. ASSEMBLY |
| 2. | 1 ¼" × 3 ⅝" Gypsum Stud with metal caps | ⅝" type FSW | +4.5 MIN. |
| 3. | 1" × 3 ⅝" Gypsum Stud with paper caps | ⅝" type FSW | +13.75 MIN. |
| 4 | 1 ¼" × 3 ⅝" ga. HDGL steel stud | ½" type FSW-B | STD. - 3/4 HR. ASSEMBLY |
| 5. | 1 ¼" × 3 ⅝" Gypsum Stud with metal caps | ½" type FSW-B | +2 MIN. |
| 6. | 1" × 3 ⅝" Gypsum Stud with paper caps | ½" type FSW-B | 8.5 MIN. |

Tests 1 and 4 deal with a standard 1.0 hour assembly and a standard 0.75 hour assembly, respectively. Test 1 was run on a typical 1.0 hour rated wall including ⅝" type X wallboard and 3-⅝" screw studs; test 4 was run on ¾ hour rated wall including ½" type X wallboard and 3-⅝" screw studs. Tests 2 and 3 show the improved time compared with test 1 and tests 5 and 6 show the improved time compared with test 4. In the above fire tests 1–6, the studs were 10' in length; in tests 1, 2, 4 and 5, the studs were spaced 24" on center; in tests 3 and 6, the studs were spaced 16" on center; gypsum boards were secured to opposite edges of the studs to form a hollow wall; in tests 3 and 6,staples were used to secure the boards to the studs, whereas in the other four type S screws were used. A heat source was placed on one side of the hollow wall and temperature sensors (thermo-couples) were placed on the opposite side of the wall. With regard to the "ENDURANCE IMPROVEMENT" column, the figure listed for each test is the time elapsed from the start of the fire test until the temperature at any thermo-couple location on the opposite side of the wall rose 325° F. above ambient temperature (see ASTM E119). In tests 1 and 4, the hot dip galvanized steel stud is the typical screw stud wall type; it has the disadvantage that it buckles due to the heat. In tests 2 and 5, the "metal caps" were constructed as shown in FIG. 6 of the drawings. In tests 3 and 6, the "paper caps" were constructed as shown in FIG. 41 but with a paper cap 284 along each edge of the stud. Further, fire tests indicate that stud design variations such as illustrated in FIG. 15 having a metal reinforcing strip, have similar heat transmissions (at the stud locations) as Test No. 3.

The following tests 7 to 15 deal with the pullout force (in pounds) required to pull a fastener from an edge of a stud. The values listed in the far right column are the averages of a number of tests. The notation n/a means not applicable; in other words, a test was not made for the specified stud design and fastener type.

gypsum core before the screw fasteners pulled out of the steel strips. Steel strips having a slightly greater thickness (from 0.0179 to 0.020 inch) than those listed in tests 8 and 9 have better holding force and have comparable costs. Also, cover material paper having a thickness larger than 0.018" yields better pullout force results. Nail pull (force before fastener pulls through gypsum wallboard) is standard at 80 pounds. In perspective, any attachment pullout from the stud exceeding this amount is adequate. Staple attachments to wood almost exclusively used in manufactured housing typically used additional PVA type adhesive. Staple attachment pullout force in the above tests are only for the initial time period while the adhesive sets.

The following tests relate to the deflection of hollow walls under a transverse load. Each of the walls included two spaced panels formed by gypsum wallboard, and vertical studs between and fastened to the wallboards. The upper and lower ends of the studs were held by rails or channels. A horizontal load or force transverse to the plane of the wallboards was applied to one side of the wall. In tests 18, 19 and 20, the gypsum wallboard was 5/16" regular, and in tests 16, 17 and 21 to 30 the wallboard was ½" regular. The

FASTENER PULLOUT FORCE

| TEST NO. | STRUCTURAL MEMBER | REINFORCEMENT MATERIAL | COVER MATERIAL | AVERAGE ULTIMATE PULLOUT FORCE (lbs.) "M" Staple | 1" Type-S screw |
|---|---|---|---|---|---|
| 7 | 1" × 2½" Gypsum Stud | .018" MR paper | .018" MR paper | 39.5 | n/a |
| 8 | 1" × 2½" Gypsum Stud | .012" steel | .018" MR paper | 31.7 | 93.5 |
| 9 | 1" × 2½" Gypsum Stud | .015" steel | .018" MR paper | 38.3 | 84.7 |
| 10 | 1" × 2½" Gypsum Stud | PVA glue only | none | 21.2 | n/a |
| 11 | 1" × 2½" Gypsum Stud | none | none | 30.3 | 35.5 |
| 12 | 1" × 2½" Gypsum Stud | Cardboard | .018" MR paper | 43.5 | n/a |
| 13 | 2" × 3" Wood Stud | n/a | n/a | 307.3 | 255.3 |
| 14 | 1¼" × 3⅝" Metal Stud | n/a | n/a | n/a | 174.7 |
| 15 | 1" × 2½" Gypsum Stud | none | .018" MR paper | 46.0 | n/a |

Tests were also conducted employing type K staples, and the results show a somewhat lower pullout force than for type M staples in the above table. In tests 8 and 9 using screw fasteners, the pullout forces of 93.5 and 84.7 were not the forces where the screws pulled loose from the steel reinforcement strips; in these tests, the paper cover material tore and the reinforcement material pulled away from the line with the notation "Deflection" indicates the amount of deflection of a wall 8 feet in height with a load of 5 pounds/ft.$^2$. The line with the notation "Limiting Height" indicates the maximum wall height permissible, which will experience an acceptable amount of deflection with a transverse load of 5 pounds/ft.$^2$, using the quarter point load method as outlined in ASTM - E72.

TRANSVERSE LOAD

| | TEST 16 | 17 | 18 | 19 | 20 |
|---|---|---|---|---|---|
| Structural Nember | GYP-Stud | Wood Stud | GYP-Stud | GYP-Stud | Wood Stud |
| Dimensions | 1" × 3⅝" | 2" × 4" | 1" × 2½" | 1" × 2½" | 2" × 3 |
| Cover Composition | 57# paper caps | SPF | 57# paper caps | 57# paper caps | SPF |
| Reinforcement Material | n/a | n/a | 57# paper | n/a | n/a |
| Attachment Method | staple | staple | staple/adhesive | staple/adhesive | staple/adhesive |
| Fastener Spacing | 8" o.c. | 8" o.c. | 8" o.c. | 8" o.c. | 8" o.c. |
| Calculated Limiting Height @ 5 PSF, L/240 Deflection (Feet) | 8.52 | 13.65 | 11.67 | 11.75 | 13.90 |
| Calculated Deflection (inch) @ 8 FT. HEIGHT | 0.248 | 0.060 | 0.097 | 0.095 | 0.057 |
| | TEST 21 | 22 | 23 | 24 | 25 |
| Structural Member | GYP-Stud | GYP-Stud | GYP-Stud | GYP-Stud | GYP-Stud |
| Dimensions | 1¼" × 3⅝" | 1¼" × 3⅝" | 1" × 3⅝" | 1¼" × 3⅝" | 1¼" × 3⅝" |

-continued

| TRANSVERSE LOAD | | | | | |
|---|---|---|---|---|---|
| Cover Composition | 57# paper caps | 57# paper caps | 57# paper caps | 57# paper caps | 57# paper caps |
| Reinforcement Material | .015 steel strip | n/a | n/a | .012 steel strip | .015 steel strip |
| Attachment Method | 1" Type S screw | staple | perpendicular staple | 1" type S screw | 1" type S screw |
| Fastener spacing | 12" o.c. | 8" o.c. | 8" o.c. | 12" o.c. | 12" o.c. |
| Calculated Limiting Height @ 5 PSF, L/240 Deflection (Feet) | 13.72 | 9.09 | 7.29 | 13.28 | 13.31 |
| Calculated Deflection (inch) @ 5 Ft. Height | 0.059 | 0.204 | 0.396 | 0.066 | 0.065 |
| | TEST 26 | 27 | 28 | 29 | 30 |
| Structural Member | GYP-Stud | Metal Stud | Metal Stud | GYP-Stud | GYP-Stud |
| Dimensions | 1¼" × 3⅝" | 1¼" × 3⅝" | 1¼" × 3⅝" | 1" × 3⅝" | 1" × 3⅝" |
| Cover Composition | 25 ga. steel caps | 20 ga. steel | 25 ga. steel | 57# paper caps | 57# paper caps |
| Reinforcement Material | n/a | n/a | n/a | n/a | 57# paper |
| Attachment Method | 1" Type s screw | 1" Type s screw | 1" Type s screw | staple/adhesive | staple |
| Fastener Spacing | 12" o.c. | 12" o.c. | 12" o.c. | 8" o.c. | 8" o.c. |
| Calculated Limiting Height @ 5 PSF, L/240 Deflection (Feet) | 13.00 | 15.69 | 13.60 | 13.57 | 8.31 |
| Calculated Deflection (inch) @ 8 Ft. Height | 0.070 | 0.040 | 0.061 | 0.061 | 0.267 |

Looking at stud manufacturing costs, including both raw materials and processing, per linear foot for residential/commercial applications, compared with a standard 2"×4" wood stud, a gypsum stud measuring 1-¼"×3-⅝", having a gypsum core covered by paper, costs about 53% less; and a gypsum stud measuring 1-¼"×3-⅝", having a gypsum core, 0.015" thick sheet metal reinforcement strips along the edges, and covered by paper, costs about 31% less.

With regard to stud manufacturing costs (raw materials and processing) per linear foot for manufactured housing applications, compared with a standard 2×"3" wood stud, a 1-¼"×2-½" gypsum stud (including a gypsum core covered by paper) costs about 43% less; a 1-¼"×2-½" gypsum stud, formed by a gypsum core, strips of paper reinforcement along the edges, and a cover of paper, costs about 38% less; and a 1-¼"×2-½" gypsum stud, formed by a gypsum core, strips of 0.015" sheet metal along the edges, and a cover of paper, costs about 20% less.

Costs using 0.019" sheet metal are probably about the same as when using 0.015" sheet metal as set out in the above two paragraphs.

A structural member in accordance with this invention has numerous advantages. In addition to a lower cost, as compared with wood and metal, for a member of a comparable size and strength, the structural members have good resistance to heat or cold transfer. In the embodiments where the edge strips are made of metal which are good thermal conductors, the metal strips on opposite edges of a member are separated by the low heat conducting core and therefore there is reduced thermal conductivity. In addition, the core acts as a heat sink (it absorbs heat), and heat drives moisture out of a core material such as gypsum and thus dissipates the heat. Metal fasteners used to secure parts together are buried in the core materials of the boards and the studs and thus are protected against overheating.

The structural member is made sufficiently strong and rigid by the combination of the core material, the side paper sheets and the edge strips. The core serves to hold the side paper sheets in straight parallel planes, and consequently the side paper sheets give the member strength and stiffness against a transverse force. The edge strips add further rigidity and strength. The side paper sheets provide needed strength against a transverse force (that is, a force parallel to the plane of the side paper sheet).

Since the side paper sheets and the rigid strips provide strength, the core may be made of a less costly material, such as lightweight gypsum, recycled gypsum, or a composition including inexpensive fillers.

Since the structural member is relatively stiff and may be secured using metal fasteners, it may be handled similarly to wood products. The parts may also be secured together by conventional adhesives used in the building industry.

What is claimed is:

1. A structural member for supporting at least one board comprising a nonheat conducting core member, said core member comprising a substrate material and further having first and second spaced apart sides and first and second spaced apart edge surfaces, the spacing between said first and second edge surfaces being equal to or greater than the spacing between said first and second sides and non-metallic first and second edge strips, the improvement comprising:

said core being susceptible to deformation in response to a load applied to one of said first and second edge surfaces, said first and second edge strips engage and cover said first and second edge surfaces, respectively, said first and second edge strips being flexible, said first and second edge strips being separated and spaced apart by said core member, said first and second edge strips being susceptible to deformation in response to the load applied to a surface of said first and second edge strips covering a respective one of the first and second edge surfaces and said first and second edge strips in cooperation with said core impeding bending of the structural member in response to the load directed to the edge surfaces when the structural member is attached to the at least one board.

2. The structural member as set forth in claim 1, wherein said core member comprises a composition including gypsum.

3. The structural member as set forth in claim 1, wherein said core member comprises a composition including gypsum and a filler material.

4. The structural member as set forth in claim 3, wherein said filler material comprises at least one material selected from the group of materials including paper fibers, synthetic fibers, wood chips and volcanic material.

5. The structural member as set forth in claim 1, wherein said edge strips comprise cover sheets, said cover sheets having first and second portions that overlap and cover a portion of said first and second sides, respectively.

6. The structural member as set forth in claim 1, wherein at least one of said cover sheets substantially covers said first side, overlaps each of said first and second edges, and has portions disposed on said second side.

7. The structural member as set forth in claim 1, wherein said edge strips are formed of a material selected from the group consisting of: a nonwoven material, a plastic material or a paper material.

8. The structural member as set forth in claim 7, wherein said nonwoven material is a paper composition.

9. The structural member as set forth in claim 1, wherein said edge strips are formed integral with a cover sheet.

10. The structural member as set forth in claim 1, further comprising first and second reinforcement members, said first and second reinforcement members being disposed between said first edge and said first edge strip and between said second edge and said second edge strip, respectively.

11. The structural member as set forth in claim 10, wherein said first and second reinforcement members comprise sheet metal strips.

12. The structural member as set forth in claim 1, wherein said core member comprises at least one gypsum board formed by a gypsum core and backing sheets.

13. The structural member as set forth in claim 1, wherein said core member comprises at least two gypsum boards which are secured together.

14. The structural member as set forth in claim 1, wherein said structural member is sized to form a wall stud.

15. The structural member as set forth in claim 1, wherein said structural member is sized to form a structure selected from the group including: a joist, a roof rafter, or a truss.

16. The structural member as set forth in claim 1, wherein said core member is made from a cementitious composition comprising gypsum and said edge strips are made from paper.

17. The structural member as set forth in claim 1, wherein each edge strip has perforations formed therein.

18. The structural member as set forth in claim 1, wherein said edge strips are adapted to securely retain a screw fastener.

19. A wall structure comprising two substantially parallel wall panels, said panels being spaced apart to form a wall space therebetween and said panels being made of gypsum board, and at least one stud located in said wall space, said stud being formed in accordance with claim 1.

* * * * *